US011225967B2

(12) United States Patent
Laville et al.

(10) Patent No.: US 11,225,967 B2
(45) Date of Patent: Jan. 18, 2022

(54) SCROLL COMPRESSOR PROVIDED WITH A STATOR WINDING BAFFLE

(71) Applicant: Danfoss Commercial Compressors, Trevoux (FR)

(72) Inventors: Alain Laville, Trévoux (FR); David Genevois, Cailloux sur Fontaine (FR); Julien Lavy, Trévoux (FR)

(73) Assignee: Danfoss Commercial Compressors, Trevoux (FR)

( * ) Notice: Subject to any disclaimer, the term of this patent is extended or adjusted under 35 U.S.C. 154(b) by 118 days.

(21) Appl. No.: 16/400,541

(22) Filed: May 1, 2019

(65) Prior Publication Data

US 2019/0383286 A1 Dec. 19, 2019

(30) Foreign Application Priority Data

Jun. 19, 2018 (FR) ..... 18/55399

(51) Int. Cl.

| | |
|---|---|
| ***F04C 18/02*** | (2006.01) |
| ***F04C 23/02*** | (2006.01) |
| ***F04C 29/04*** | (2006.01) |

(52) U.S. Cl.

CPC ..... *F04C 18/0215* (2013.01); *F04C 23/02* (2013.01); *F04C 29/045* (2013.01); *F04C 2210/22* (2013.01); *F04C 2240/40* (2013.01)

(58) Field of Classification Search

CPC ..... F04B 39/121; F04B 2240/40; F04B 18/0215; F04B 23/02; F04B 2210/22;

(Continued)

(56) References Cited

U.S. PATENT DOCUMENTS 4,477,233 A 10/1984 Schaefer
5,007,809 A * 4/1991 Kimura ..... F04C 29/045 417/371

(Continued)

FOREIGN PATENT DOCUMENTS

CN 1181128 A 5/1998
CN 1409014 A 4/2003

(Continued)

OTHER PUBLICATIONS

French Search Report for Serial No. FR 1855399 dated Feb. 22, 2019.

(Continued)

*Primary Examiner* — Kenneth J Hansen

(74) *Attorney, Agent, or Firm* — McCormick, Paulding & Huber PLLC

(57) ABSTRACT

The scroll compressor (2) comprises a hermetic enclosure (3) comprising an outer shell (4); a compression unit (11) arranged within the hermetic enclosure (3); an electric motor (21) configured to drive the compression unit (11), the electric motor (21) including a rotor (22) and a stator (23); and an inner shell (26) in which the electric motor (21) is arranged. A baffle (34) is arranged inside the inner shell (26) at a stator end winding (25) of the electric motor (21), the baffle (34) comprising deflecting means configured to deflect at least a part of a main refrigerant flow, flowing inside the inner shell (26), towards said stator end winding (25).

18 Claims, 3 Drawing Sheets

(58) Field of Classification Search
CPC ..... H02K 9/12; H02K 9/19; F04C 39/121; F04C 2240/40; F04C 18/0215; F04C 23/02; F04C 2210/22; F04C 29/045
See application file for complete search history.

(56) References Cited

U.S. PATENT DOCUMENTS

| | | | | |
|---|---|---|---|---|
| 5,533,875 | A | 7/1996 | Crum et al. | |
| 6,042,346 | A * | 3/2000 | Doi | F04C 23/008 417/371 |
| 6,960,070 | B2 * | 11/2005 | Kammhoff | F04C 29/126 184/6.18 |
| 2002/0157409 | A1 | 10/2002 | Pham et al. | |
| 2003/0063986 | A1 | 4/2003 | Ginies et al. | |
| 2013/0272910 | A1 | 10/2013 | Genevois et al. | |
| 2014/0294641 | A1 | 10/2014 | Kanaizumi et al. | |
| 2017/0241420 | A1 | 8/2017 | Nouyrigat et al. | |

FOREIGN PATENT DOCUMENTS

| | | | |
|---|---|---|---|
| CN | 1420967 | A | 5/2003 |
| CN | 1497182 | A | 5/2004 |
| CN | 102269164 | A | 12/2011 |
| CN | 103375403 | A | 10/2013 |
| CN | 104061160 | B | 1/2016 |
| CN | 105443377 | A | 3/2016 |
| FR | 2989433 | A1 | 10/2013 |
| FR | 3027633 | A1 | 4/2016 |

OTHER PUBLICATIONS

Indian First Examination Report for Application No. 201914015710 dated Sep. 15, 2020.

* cited by examiner

SCROLL COMPRESSOR PROVIDED WITH A STATOR WINDING BAFFLE

CROSS-REFERENCE TO RELATED APPLICATION

This application claims foreign priority benefits under U.S.C. § 119 to French Patent Application No. FR 18/55399 filed on Jun. 19, 2018, the content of which is hereby incorporated by reference in its entirety.

TECHNICAL FIELD

The present invention relates to a scroll compressor, and in particular to a hermetic scroll compressor.

BACKGROUND

U.S. Pat. No. 5,533,875 discloses a scroll compressor comprising:

a hermetic enclosure comprising an outer shell, a compression unit arranged within the hermetic enclosure, an electric motor configured to drive the compression unit, the electric motor including a rotor and a stator disposed around the rotor, a circular gap being defined between the rotor and the stator, and an inner shell in which the electric motor is arranged, outer flow channels being formed between the outer surface of the stator and the inner surface of the inner shell, and The scroll compressor is configured such that, in use, a main refrigerant flow flows inside the inner shell from a lower end of the electric motor towards an upper end of the electric motor. Particularly the main refrigerant flow includes a first refrigerant flow part which flows through the outer flow channels and a second refrigerant flow part which flows through the circular gap.

In this way, the major part of the refrigerant gas entering the scroll compressor passes a lower stator end winding of the electric motor, passes through the circular gap, passes through the outer flow channels formed between the outer surface of the stator and the inner surface of the inner shell, and then passes the upper stator end winding.

Hereby, a good motor cooling performance is achieved so far, before the refrigerant gas is entering the scroll compression pockets of the compressor unit.

A minor part of the refrigerant gas entering the scroll compressor may eventually bypass the electric motor and flow directly to the compression unit.

However, when using low-density refrigerants (e.g. R32), the cooling performance of the refrigerant flow is reduced, compared to traditional refrigerants (e.g. R410A) having higher density. Hence, there is a problem of overheating the electric motor, especially the upper stator end winding, during high motor load.

SUMMARY

It is an object of the present invention to provide an improved scroll compressor which can overcome the drawbacks encountered in conventional scroll compressors.

Another object of the present invention is to provide a scroll compressor which has an improved cooling efficiency in order to enlarge the operating window of the scroll compressor.

According to the invention such a scroll compressor comprises:

a hermetic enclosure comprising an outer shell, a compression unit arranged within the hermetic enclosure, an electric motor configured to drive the compression unit, the electric motor including a rotor and a stator disposed around the rotor, and an inner shell in which the electric motor is arranged, wherein a baffle is arranged inside the inner shell at a stator end winding of the electric motor, the baffle comprising deflecting means configured to deflect at least a part of a main refrigerant flow, flowing inside the inner shell (for example from a lower end of the electric motor towards an upper end of the electric motor), towards said stator end winding.

The presence of such a baffle ensures a more intensive contact between the refrigerant gas flow and the winding wires of the stator end winding, which results in improving heat transfer between the stator end winding and the refrigerant gas, and thus in improving cooling efficiency of the scroll compressor.

The scroll compressor may also include one or more of the following features, taken alone or in combination.

According to an embodiment of the invention, the baffle is arranged at an upper stator end winding of the electric motor, and wherein the deflecting means are configured to deflect at least a part of a main refrigerant flow, flowing inside the inner shell from a lower end of the electric motor towards an upper end of the electric motor, towards the upper stator end winding According to an embodiment of the invention, the baffle covers the upper stator end winding.

According to an embodiment of the invention, the baffle has a circular ring shape.

According to an embodiment of the invention, the baffle includes a first axial section having an outer diameter substantially corresponding to an inner diameter of the inner shell, and a second axial section having an outer diameter smaller than the outer diameter of the first axial section and having an inner diameter larger than an outer diameter of said stator end winding, and particularly of the upper stator end winding.

According to an embodiment of the invention, the first and second axial sections are offset with respect to each other in an axial direction of the electric motor, and are advantageously vertically offset with respect to each other.

According to an embodiment of the invention, the first axial section includes at least one circumferential guiding portion having an inner guiding surface, the deflecting means and the inner guiding surface of the at least one circumferential guiding portion are configured to force a refrigerant flow entering the baffle in close contact to said stator end winding, and particularly to the upper stator end winding.

According to an embodiment of the invention, the at least one circumferential guiding portion has an outer surface which is located away from the inner surface of the inner shell. Advantageously, the outer surface the at least one circumferential guiding portion is recessed, i.e. defines a recess.

According to an embodiment of the invention, the inner guiding surface of the at least one circumferential guiding portion defines a bump portion.

According to an embodiment of the invention, the at least one circumferential guiding portion extends inwardly.

According to an embodiment of the invention, a lower axial end surface of the at least one circumferential guiding portion rests on an upper surface of a stator core.

According to an embodiment of the invention, the first axial section has a substantially circular ring shape. Advantageously, the at least one circumferential guiding portion deviates from the substantially circular ring shape of the first axial section.

According to an embodiment of the invention, the at least one circumferential guiding portion is flat or is curved. Advantageously, the outer surface of the at least one circumferential guiding portion is concave and the inner guiding surface of the at least one circumferential guiding portion is convex.

According to an embodiment of the invention, the first axial section includes at least one arcuate portion, and for example at least one circular arcuate portion, adjacent the at least one circumferential guiding portion, the at least one arcuate portion having a radius of curvature substantially corresponding to a radius of curvature of the inner surface of the inner shell.

According to an embodiment of the invention, a central portion of the at least one circumferential guiding portion is closer to a central axis of the baffle than the at least one arcuate portion.

According to an embodiment of the invention, a lower axial end of the at least one circumferential guiding portion protruding in an axial direction from a lower axial end of the at least one arcuate portion.

According to an embodiment of the invention, the first axial section includes a plurality of circumferential guiding portions which are angularly offset and circumferentially distributed, and a plurality of arcuate portions which are angularly offset and circumferentially distributed, each of the arcuate portions extending between two adjacent circumferential guiding portions.

According to an embodiment of the invention, the baffle further comprise a radially extending end wall which extends from the second axial section, the radially extending end wall defining a refrigerant outlet opening.

According to an embodiment of the invention, the radially extending end wall is located above said stator end winding, and particularly above the upper stator end winding.

According to an embodiment of the invention, the refrigerant outlet opening has an inner diameter smaller than the inner diameter of the stator.

According to an embodiment of the invention, a circular gap is defined between the rotor and the stator, and at least one outer flow channel is formed between the outer surface of the stator and the inner surface of the inner shell, the scroll compressor being configured such that a first refrigerant flow part of the main refrigerant flow flows through the at least one outer flow channel and a second refrigerant flow part of the main refrigerant flow flows through the circular gap.

According to an embodiment of the invention, the at least one outer flow channel is formed by the inner surface of the inner shell and at least one flat peripheral portion of the outer surface of the stator core.

According to an embodiment of the invention, a distance between the inner surface of the second axial section and the outer surface of said stator end winding (and particularly of the upper stator end winding) defines a flow channel for the first refrigerant flow part of the main refrigerant flow. Advantageously, the width of the flow channel is configured to ensure a good heat transfer between refrigerant and said stator end winding without excessive pressure losses.

According to an embodiment of the invention, the baffle is angularly oriented in relation to the stator such that the at least one outer flow channel is axially aligned with the at least one arcuate portion of the baffle. Advantageously, the baffle is angularly oriented in relation to the stator such that each outer flow channel is axially aligned with a respective arcuate portion of the baffle.

According to an embodiment of the invention, the scroll compressor is configured such that the second refrigerant flow part coming from the circular gap flows along the radial inner surface of the upper end stator winding and then along the outer surface of an upper bearing structure. Thus the second refrigerant flow part is less affected by the baffle than the first refrigerant flow part.

According to an embodiment of the invention, the refrigerant outlet opening defined by the radially extending end wall is dimensioned such that the second refrigerant flow part flows through the refrigerant outlet opening substantially unrestricted.

According to an embodiment of the invention, the baffle and the stator define at least one refrigerant inlet opening through which the first refrigerant flow part can enter the baffle. Thus the at least one refrigerant inlet opening ease the entry of the first refrigerant flow part from the at least one outer flow channel into the inside of the baffle. Such a configuration of the baffle reduces the pressure losses.

Advantageously, the baffle and the stator define a plurality of refrigerant inlet openings through which the first refrigerant flow part of the main refrigerant flow can enter the baffle, the refrigerant inlet openings being angularly offset and circumferentially distributed.

According to an embodiment of the invention, each of the refrigerant inlet openings is defined by the stator core and the lower axial end of a respective arcuate portion.

According to an embodiment of the invention, the first axial section is configured to collect the first refrigerant flow part of the main refrigerant flow and to deflect the first refrigerant flow part in both radial and circumferential directions along the surface of said stator end winding, and particularly of the upper stator end winding.

According to an embodiment of the invention, the second axial section of the baffle comprises a cylindrical wall portion.

According to an embodiment of the invention, the deflecting means includes a plurality of deflecting elements formed on the inner surface of the baffle.

According to an embodiment of the invention, each of the deflecting elements protrudes from a transition portion between the first and second axial sections.

According to an embodiment of the invention, each of the deflecting elements includes a curved blade shaped wall.

According to an embodiment of the invention, each of the deflecting elements is configured to deflect a part of the main refrigerant flow, and for example a part of the first refrigerant flow part, towards a respective circumferential guiding portion.

According to an embodiment of the invention, each of the deflecting elements includes an upper connecting part extending from the transition portion, and a lateral connection part extending from the inner surface of an arcuate portion.

According to an embodiment of the invention, each of the deflecting elements defines a deflecting recess which is downwardly open and which is laterally open.

According to an embodiment of the invention, each of the deflecting elements includes a lateral free edge which is away from the inner surface of the first axial section, and particularly of the inner surface of a respective arcuate portion.

According to an embodiment of the invention, each of the deflecting elements is formed near, for example in the area of, an arcuate portion. Advantageously, two deflecting elements are formed at each arcuate portion.

According to an embodiment of the invention, the deflecting elements and the guiding inner surfaces of the circumferential guiding portions are configured to force a refrigerant flow entering the baffle in close contact to said stator end winding, and particularly to the upper stator end winding.

According to an embodiment of the invention, the baffle further includes mounting bosses which are circumferentially distributed, the mounting bosses protruding from the outer surface of the second axial section and extending radially outwardly.

According to an embodiment of the invention, radial end surfaces of the mounting bosses cooperate with the inner surface of the inner shell. The mounting bosses can be used to secure the baffle to the inner shell, e.g. by screws. Preferably, each mounting boss comprises a threaded insert, and for example a metallic threaded insert, to accommodate a suitable fixing element.

Alternatively, the baffle may be secured to the inner shell by further known methods, such as adhesive, clips and rivets, or by press fit.

According to an embodiment of the invention, the baffle may be produced in metallic or plastic materials, preferably in glass-fiber reinforced plastic materials, e.g. PA66. Alternatively, the baffle may be manufactured with additive manufacturing processes.

According to an embodiment of the invention, the inner shell has a cylindrical shape.

According to an embodiment of the invention, the inner shell is formed by an inner shell tube.

According to an embodiment of the invention, the scroll compressor includes a refrigerant suction inlet formed in the outer shell and configured to supply the scroll compressor with refrigerant to be compressed.

According to an embodiment of the invention, the inner shell surrounds the electric motor.

According to an embodiment of the invention, the electric motor is entirely mounted inside the inner shell.

According to an embodiment of the invention, the inner shell and the electric motor define a proximal chamber containing the upper stator end winding, and a distal chamber containing a lower stator end winding, also named lower stator winding head.

According to an embodiment of the invention, the baffle is arranged inside the proximal chamber.

According to an embodiment of the invention, the upper stator end winding is formed by the portions of stator windings extending upwardly from an upper end face of a stator core, and the lower stator end winding is formed by the portions of the stator windings extending downwardly from a lower end face of the stator core.

According to an embodiment of the invention, the scroll compressor includes at least one refrigerant inlet aperture emerging in the distal chamber. The at least one refrigerant inlet aperture may be provided on the inner shell.

According to an embodiment of the invention, the refrigerant inlet aperture is configured to fluidly connect the distal chamber and an annular volume delimited by the inner shell and the outer shell.

According to an embodiment of the invention, the compression unit includes a fixed scroll having a fixed base plate and a fixed spiral wrap, and an orbiting scroll having an orbiting base plate and an orbiting spiral wrap, the fixed spiral wrap and the orbiting spiral wrap forming a plurality of compression chambers.

According to an embodiment of the invention, the compression unit divides the space inside the hermetic enclosure into a suction pressure volume and a discharge pressure volume.

According to an embodiment of the invention, an upper end of the inner shell is secured to the upper bearing structure.

These and other advantages will become apparent upon reading the following description in view of the drawings attached hereto representing, as non-limiting example, one embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
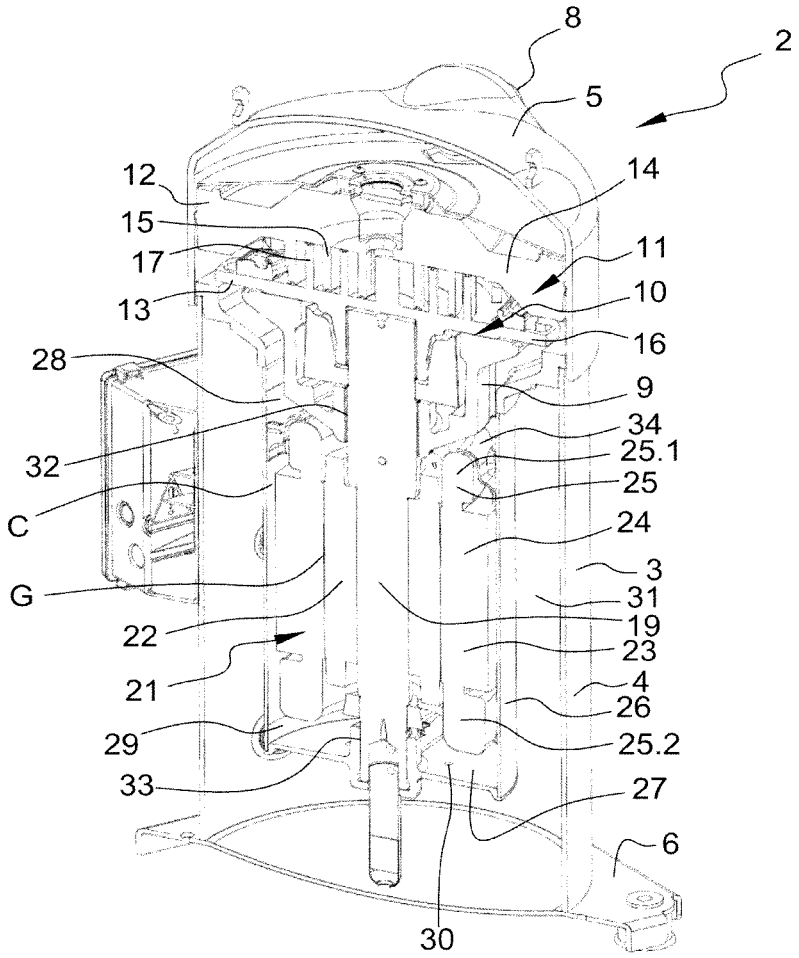
FIG. 1 is a longitudinal section view, in perspective, of a scroll compressor according to the invention.
Figure 2:
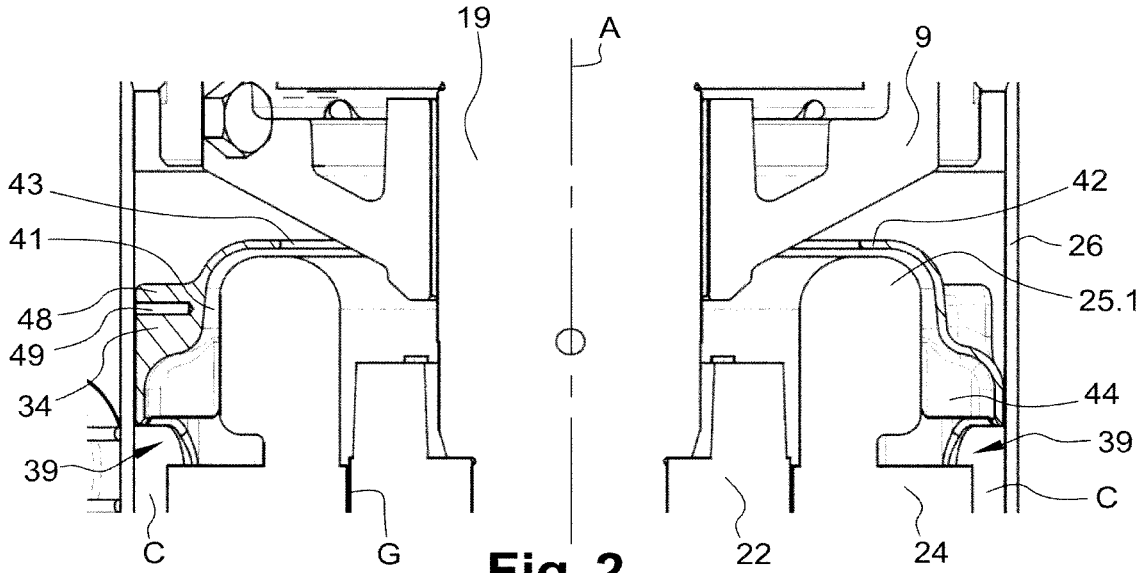
FIG. 2 is a partial longitudinal section view of the scroll compressor of FIG. 1.

FIG. 1 shows a scroll compressor 2 comprising a hermetic enclosure 3 including an outer shell 4, an upper cap 5 and a baseplate 6. As shown on FIG. 1, the outer shell 4 is cylindrical and includes an upper end closed by the upper cap 5 and a lower end closed by the baseplate 6. According to the embodiment shown on the figures, the outer shell 4 has a constant diameter over its entire length.

The scroll compressor 2 further comprises a refrigerant suction inlet (not shown on the figures) provided on the outer shell 4 and configured to supply the scroll compressor 2 with refrigerant to be compressed, and a discharge outlet 8 configured to discharge compressed refrigerant. For example, the discharge outlet 8 may be provided on the upper cap 5.

The scroll compressor 2 also comprises a support frame 9 arranged within the hermetic enclosure 3 and secured to the hermetic enclosure 3, and a compression unit 11 also arranged within the hermetic enclosure 3 and disposed above the support frame 9. The compression unit 11 is configured to compress the refrigerant supplied by the refrigerant suction inlet, and includes a fixed scroll 12, which is fixed in relation to the hermetic enclosure 3, and an orbiting scroll 13 supported by and in slidable contact with a thrust bearing surface 10 provided on the support frame 9.

The fixed scroll 12 includes a fixed scroll base plate 14 having a lower face oriented towards the orbiting scroll 13, and an upper face opposite to the lower face of the fixed scroll base plate 14. The fixed scroll 12 also includes a fixed spiral wrap 15 protruding from the lower face of the fixed scroll base plate 14 towards the orbiting scroll 13.

The orbiting scroll 13 includes an orbiting scroll base plate 16 having an upper face oriented towards the fixed scroll 12, and a lower face opposite to the upper face of the orbiting scroll base plate 16 and slidably mounted on the thrust bearing surface 10. The orbiting scroll 13 also includes an orbiting spiral wrap 17 protruding from the upper face of the orbiting base plate 16 towards the fixed scroll 12. The orbiting spiral wrap 17 meshes with the fixed spiral wrap 15 to form a plurality of compression chambers between them. Each of the compression chambers has a variable volume which decreases from the outside towards the inside, when the orbiting scroll 13 is driven to orbit relative to the fixed scroll 12.

Furthermore the scroll compressor 2 includes a drive shaft 19 configured to drive the orbiting scroll 13 in an orbital movement, and an electric motor 21, which may be a variable-speed electric motor, coupled to the drive shaft 19 and configured to drive in rotation the drive shaft 19 about a rotational axis A.

The electric motor 21 has a rotor 22 fitted on the drive shaft 19, and a stator 23 disposed around the rotor 22. The stator 23 includes a stator stack or stator core 24, and stator windings wound on the stator core 24. The stator windings define two stator end windings 25, and particularly an upper stator end winding 25.1 which is formed by the portions of the stator windings extending outwardly from an upper end face of the stator core 24 which is oriented towards the compression unit 11, and a lower stator end winding 25.2 which is formed by the portions of the stator windings extending outwardly from a lower end face of the stator core 24 which is opposite to the compression unit 11.

The scroll compressor 2 further includes an inner shell 26 surrounding the electric motor 21 and in which the electric motor 21 is entirely mounted. According to the embodiment shown on the figures, an upper end of the inner shell 26 is secured to the support frame 9, and a lower end of the inner shell 26 is secured to a centering member 27 secured to the outer shell 4. As shown in FIG. 1, the inner shell 26 and the electric motor 21 define a proximal chamber 28 containing the upper stator end winding 25.1 of the stator 23, and a distal chamber 29 containing the lower stator end winding 25.2 of the stator 23. The stator 23 may be secured to the inner shell 26, e.g. by press fitting, shrink fitting, welding, screwing or other suitable methods.

Furthermore the scroll compressor 2 includes one or several refrigerant inlet aperture(s) (not shown in the drawings) emerging in the distal chamber 29. Each refrigerant inlet aperture is particularly configured to fluidly connect the distal chamber 29 and an annular volume 31 delimited by the inner shell 26 and the outer shell 4, such that a main refrigerant flow, entering the distal chamber 29 through the refrigerant inlet aperture(s), may flow inside the inner shell 26 from a lower end of the electric motor 21 towards an upper end of the electric motor 31. According to an embodiment of the invention, the or each refrigerant inlet aperture may be provided on a lower end portion of the inner shell 26.

According to the embodiment shown on the figures, a circular gap G is defined between the rotor 22 and the stator 23, and a plurality of outer flow channels C are formed between the outer surface of the stator 23 and the inner surface of the inner shell 26. Advantageously, the outer flow channels C are angularly offset and circumferentially distributed. Each outer flow channel C may particularly be defined by the inner surface of the inner shell 26 and a respective flat peripheral portion of the outer surface of the stator core 24.

Particularly, the scroll compressor 2 is configured such that a first refrigerant flow part of the main refrigerant flow flows through the outer flow channels C and a second refrigerant flow part of the main refrigerant flow flows through the circular gap G.

The scroll compressor 2 further includes an upper bearing member 32 provided on the support frame 9 and configured to cooperate with an outer circumferential wall surface of an upper end portion of the drive shaft 19, and a lower bearing member 33 provided on the centering member 27 and configured to cooperate with an outer circumferential wall surface of a lower end portion of the drive shaft 19. The lower bearing member 33 and the upper bearing member 32 are particularly configured to rotatably support the drive shaft 19.

The scroll compressor 2 also includes a baffle 34 having a circular ring shape and being arranged inside the inner shell 26 at the upper stator end winding 25.1. The baffle 34 is particularly arranged inside the proximal chamber 28 so as to cover the upper stator end winding 25.1. The baffle 34 may be produced in metallic or plastic materials, preferably in glass-fiber reinforced plastic materials, e.g. PA66. Alternatively, the baffle 34 may be manufactured with additive manufacturing processes.

The baffle 34 includes a first axial section 35 having an outer diameter substantially corresponding to an inner diameter of the inner shell 26, and a second axial section 36 having an outer diameter smaller than the outer diameter of the first axial section 35 and having an inner diameter larger than an outer diameter of the upper stator end winding 25.1. Advantageously, each of the first and second axial sections 35, 36 has a substantially circular ring shape.

Figure 4:
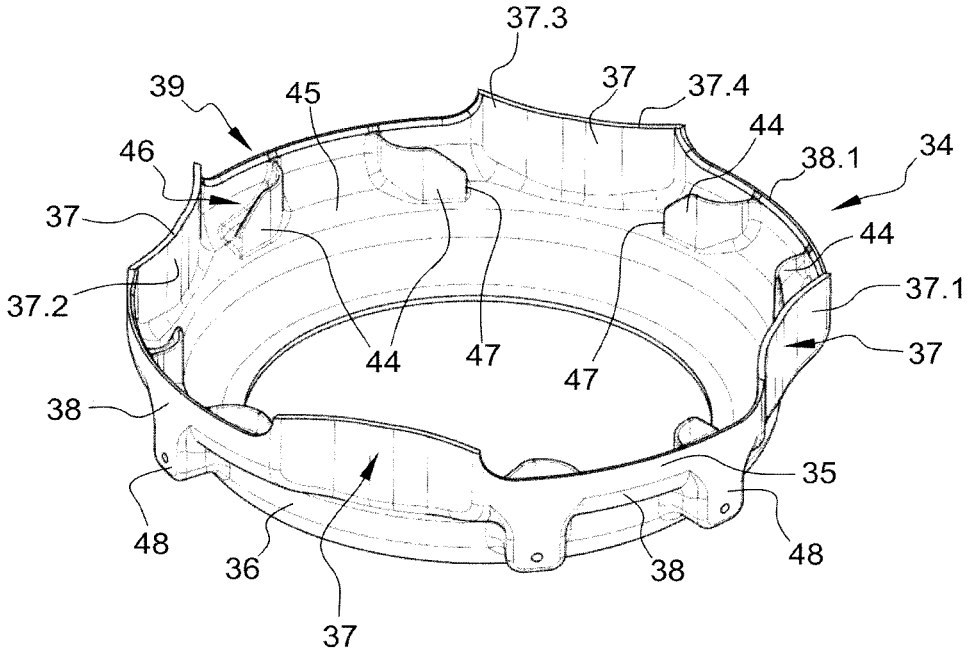
FIG. 4 is a perspective view from below of the baffle of FIG. 3.
Figure 5:
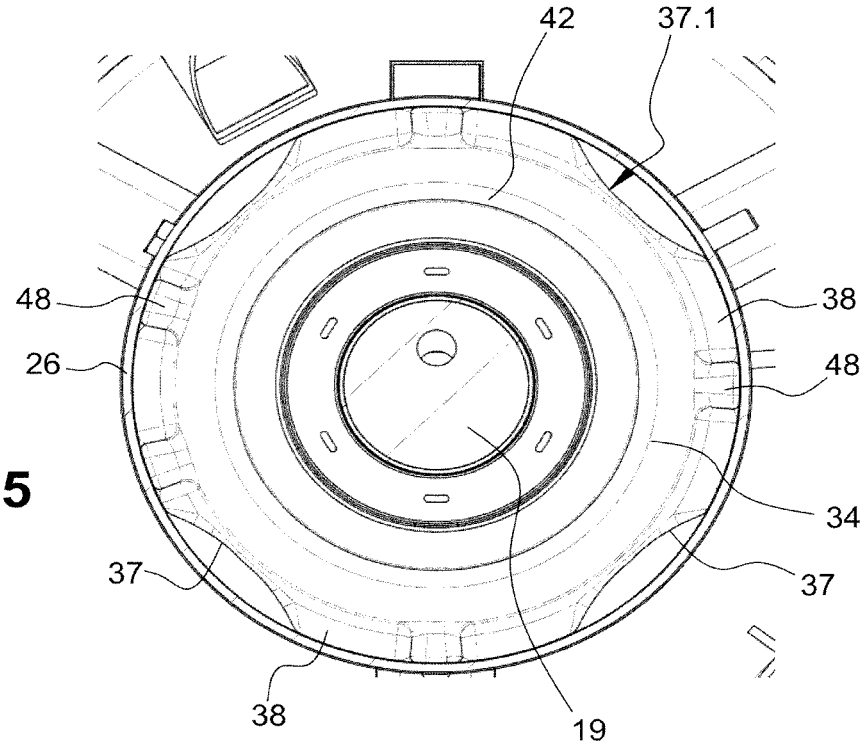
FIG. 5 is a cross section view of the scroll compressor of FIG. 1.
Figure 6:
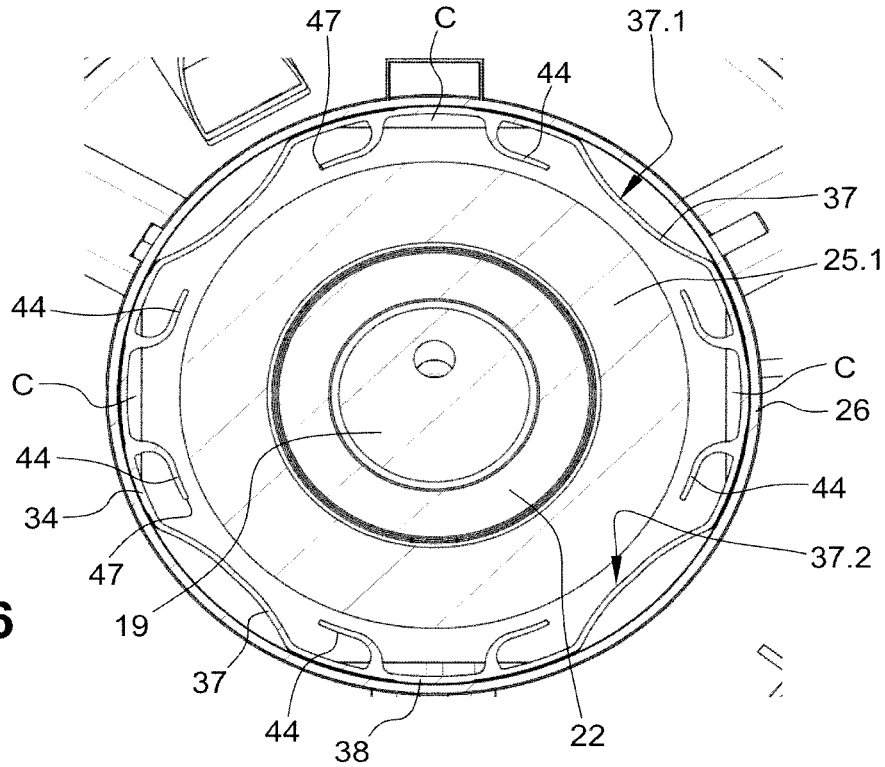
FIG. 6 is another cross section view of the scroll compressor of FIG. 1.

As better shown on FIGS. 4 and 5, the first axial section 35 includes a plurality of circumferential guiding portions 37 which are angularly offset and circumferentially distributed, and a plurality of arcuate portions 38 which are angularly offset and circumferentially distributed. Each arcuate portion 38 is a circular arcuate portion and has a radius of curvature substantially corresponding to a radius of curvature of the inner surface of the inner shell 26, and particularly extends between two adjacent circumferential guiding portions 37. Advantageously, the baffle 34 is angularly oriented in relation to the stator 23 such that each outer flow channel C is axially aligned with a respective arcuate portion 38 of the baffle 34.

Each circumferential guiding portion 37 has an outer surface 37.1 which is located away from the inner surface of the inner shell 26. Advantageously, the outer surface 37.1 of each circumferential guiding portion 37 is recessed, i.e. defines a recess. Further each circumferential guiding portion 37 has an inner guiding surface 37.2 which defines a bump portion.

According to the embodiment shown on the figures, each circumferential guiding portion 37 is curved and extends inwardly. Particularly the outer surface 37.1 of each circumferential guiding portion 37 is concave and the inner guiding surface 37.2 of each circumferential guiding portion 37 is convex.

Further each circumferential guiding portion 37 includes a lower axial end 37.3 protruding in an axial direction from the lower axial ends 38.1 of the arcuate portions 38, and a lower axial end surface 37.4 which rests on an upper surface of the stator core 24.

Moreover the baffle 34 and the stator 23 define a plurality of refrigerant inlet openings 39 which are angularly offset and circumferentially distributed, and through which the first refrigerant flow part of the main refrigerant flow can enter the baffle 34. Advantageously, each refrigerant inlet opening 39 is defined by the stator core 24 and the lower axial end 38.1 of a respective arcuate portion 38.

According to the embodiment shown on the figures, the inner surface of the second axial section 36 and the outer surface of the upper stator end winding 25.1 define a flow channel 41 for the first refrigerant flow part of the main refrigerant flow. Advantageously, the width of the flow channel 41 is configured to ensure a good heat transfer between refrigerant and the upper stator end winding 25.1 without excessive pressure losses.

The baffle 34 further comprise a radially extending end wall 42 which extends from the second axial section 36. The radially extending end wall 42 is located above the upper stator end winding 25.1 and defines a refrigerant outlet opening 43 which has a circular shape. Advantageously, the refrigerant outlet opening 43 has an inner diameter smaller than the inner diameter of the stator 23.

The scroll compressor 2 is particularly configured such that the second refrigerant flow part of the main refrigerant flow, coming from the circular gap G, flows along the radial inner surface of the upper end stator winding 25.1, through the refrigerant outlet opening 43 and then along the outer surface of the support frame 9. Advantageously, the refrigerant outlet opening 43 is dimensioned such that the second refrigerant flow part flows through the refrigerant outlet opening 43 substantially unrestricted. Thus the second refrigerant flow part is less affected by the baffle 34 than the first refrigerant flow part.

The baffle 34 further includes deflecting means configured to deflect at least a part of the first refrigerant flow part towards the upper stator end winding 25.1. The deflecting means include a plurality of deflecting elements 44 formed on the inner surface of the baffle 34. According to the embodiment shown on the figures, each deflecting element 44 protrudes from the inner surface of a transition portion 45 located between the first and second axial sections 35, 36, and is partially located at an arcuate portion 38. Advantageously, two deflecting elements 44 are formed at each arcuate portion 38.

Further each deflecting element 44 defines a deflecting recess 46 which is downwardly open and which is laterally open. Advantageously each deflecting element 44 includes a curved blade shaped wall and a lateral free edge 47 which is away from the inner surface of the first axial section 35.

Each deflecting element 44 is particularly configured to deflect a part of the first refrigerant flow part towards a respective circumferential guiding portion 37. Therefore the first axial section 35 is configured to collect the first refrigerant flow part of the main refrigerant flow and to deflect the first refrigerant flow part in both radial and circumferential directions along the outer surface of the upper stator end winding 25.1. Furthermore the deflecting elements 44 and the guiding inner surfaces 37.1 of the circumferential guiding portions 37 are configured to force a part of the first refrigerant flow part entering the baffle 34 in close contact to the upper stator end winding 25.1.

Figure 3:
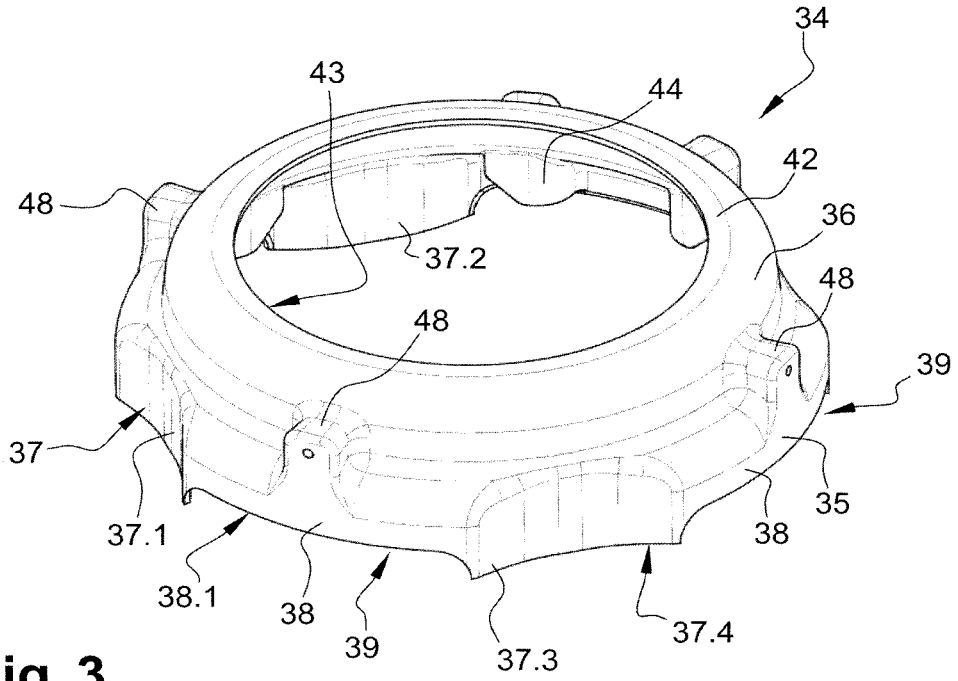
FIG. 3 is a perspective view from above of a baffle of the scroll compressor of FIG. 1.

As better shown on FIGS. 3 and 5, the baffle 34 further includes mounting bosses 48 which are circumferentially distributed. Each mounting boss 48 protrudes from the outer surface of the second axial section 36 and extends radially outwardly. Particularly radial end surfaces of the mounting bosses 48 cooperate with the inner surface of the inner shell 26.

The mounting bosses 48 may be used to secure the baffle 34 to the inner shell 26, e.g. by screws. Preferably, each mounting boss 48 comprises a threaded insert 49, and for example a metallic threaded insert, to accommodate a suitable fixing element. Alternatively, the baffle 34 may be secured to the inner shell 26 by further known methods, such as adhesive, clips and rivets, or by press fit.

Of course, the invention is not restricted to the embodiment described above by way of non-limiting example, but on the contrary it encompasses all embodiments thereof. Particularly, the baffle 34 could be used in a scroll compressor 2 where the electric motor 21 is arranged in a high pressure volume, instead of the low pressure (suction pressure) volume as shown in the drawings.

What is claimed is:

1. A scroll compressor comprising:

a hermetic enclosure comprising an outer shell, a compression unit arranged within the hermetic enclosure, an electric motor configured to drive the compression unit with a drive shaft, the electric motor including a rotor and a stator, and an inner shell arranged within the hermetic enclosure and in which the electric motor is arranged, wherein a baffle is arranged inside the inner shell at a stator end winding of the electric motor, the baffle comprising deflecting means configured to deflect at least a part of a main refrigerant flow, flowing inside the inner shell, towards said stator end winding;

wherein the baffle defines a refrigerant outlet opening;

wherein the drive shaft is arranged in the refrigerant outlet opening wherein the baffle has a circular ring shape;

wherein the baffle includes a first axial section having an outer diameter substantially corresponding to an inner diameter of the inner shell, and a second axial section having an outer diameter smaller than the outer diameter of the first axial section and having an inner diameter larger than an outer diameter of said stator end winding; and wherein the baffle further comprises a radially extending end wall which extends from the second axial section, the radially extending end wall defining the refrigerant outlet opening.

2. The scroll compressor according to claim 1, wherein the first axial section includes at least one circumferential guiding portion having an inner guiding surface, the deflecting means and the inner guiding surface of the at least one circumferential guiding portion are configured to force a refrigerant flow entering the baffle in contact to said stator end winding.

3. The scroll compressor according to claim 2, wherein a lower axial end surface of the at least one circumferential guiding portion rests on an upper surface of a stator core.

4. The scroll compressor according to claim 3, wherein the first axial section includes at least one arcuate portion adjacent the at least one circumferential guiding portion, the at least one arcuate portion having a radius of curvature substantially corresponding to a radius of curvature of an inner surface of the inner shell.

5. The scroll compressor according to claim 2, wherein the first axial section includes at least one arcuate portion adjacent the at least one circumferential guiding portion, the at least one arcuate portion having a radius of curvature substantially corresponding to a radius of curvature of an inner surface of the inner shell.

6. The scroll compressor according to claim 5, wherein a lower axial end of the at least one circumferential guiding portion protruding in an axial direction from a lower axial end of the at least one arcuate portion.

7. The scroll compressor according to claim 2, wherein the first axial section includes a plurality of circumferential guiding portions which are angularly offset and circumferentially distributed, and a plurality of arcuate portions which are angularly offset and circumferentially distributed, each of the arcuate portions extending between two adjacent circumferential guiding portions.

8. The scroll compressor according to claim 1, wherein a circular gap (G) is defined between the rotor and the stator, and at least one outer flow channel (C) is formed between an outer surface of the stator and an inner surface of the inner shell, the scroll compressor being configured such that a first refrigerant flow part of the main refrigerant flow flows through the at least one outer flow channel (C) and a second refrigerant flow part of the main refrigerant flow flows through the circular gap (G).

9. The scroll compressor according to claim 8, wherein the baffle and the stator define at least one refrigerant inlet opening through which the first refrigerant flow part can enter the baffle.

10. The scroll compressor according to claim 8, wherein the first axial section is configured to collect the first refrigerant flow part of the main refrigerant flow and to deflect the first refrigerant flow part in both radial and circumferential directions along a surface of said stator end winding.

11. The scroll compressor according to claim 8, wherein the baffle is angularly oriented in relation to the stator such that the at least one outer flow channel (C) is axially aligned with the at least one arcuate portion of the baffle.

12. The scroll compressor according to claim 1, wherein the deflecting means includes a plurality of deflecting elements formed on an inner surface of the baffle.

13. The scroll compressor according to claim 12, wherein each of the deflecting elements protrudes from a transition portion between the first and second axial sections.

14. The scroll compressor according to claim 12, wherein each of the deflecting elements includes a curved blade shaped wall.

15. The scroll compressor according to claim 12, wherein each of the deflecting elements is configured to deflect a part of the main refrigerant flow towards a respective circumferential guiding portion.

16. The scroll compressor according to claim 1, wherein the baffle is arranged at an upper stator end winding of the electric motor, and wherein the deflecting means are configured to deflect at least a part of the main refrigerant flow, flowing inside the inner shell from a lower end of the electric motor towards an upper end of the electric motor, towards the upper stator end winding.

17. The scroll compressor according to claim 16, wherein the baffle covers the upper stator end winding.

18. A scroll compressor comprising:

a hermetic enclosure comprising an outer shell, a compression unit arranged within the hermetic enclosure, an electric motor configured to drive the compression unit with a drive shaft, the electric motor including a rotor and a stator, and an inner shell arranged within the hermetic enclosure and in which the electric motor is arranged, wherein a baffle is arranged inside the inner shell at a stator end winding of the electric motor, the baffle comprising deflecting means configured to deflect at least a part of a main refrigerant flow, flowing inside the inner shell, towards said stator end winding;

wherein the baffle defines a refrigerant outlet opening;

wherein the drive shaft is arranged in the refrigerant outlet opening;

wherein the baffle has a circular ring shape;

wherein the baffle includes a first axial section having an outer diameter substantially corresponding to an inner diameter of the inner shell, and a second axial section having an outer diameter smaller than the outer diameter of the first axial section and having an inner diameter larger than an outer diameter of said stator end winding;

wherein the first axial section includes at least one circumferential guiding portion having an inner guiding surface, the deflecting means and the inner guiding surface of the at least one circumferential guiding portion are configured to force a refrigerant flow entering the baffle in contact to said stator end winding;

wherein the first axial section includes at least one arcuate portion adjacent the at least one circumferential guiding portion, the at least one arcuate portion having a radius of curvature substantially corresponding to a radius of curvature of an inner surface of the inner shell; and wherein a lower axial end of the at least one circumferential guiding portion protruding in an axial direction from a lower axial end of the at least one arcuate portion.

* * * * *